US008740653B2

(12) United States Patent
Zeng

(10) Patent No.: US 8,740,653 B2
(45) Date of Patent: Jun. 3, 2014

(54) SOCKET HAVING AN INSULATING HOUSING WITH A CONDUCTIVE SILICONE RUBBER INSERT FOR HOLDING AND ELECTRICALLY CONNECTING A LIGHT TUBE

(75) Inventor: Dawei Zeng, Guangdong (CN)

(73) Assignee: Shenzhen China Star Optoelectronics Technology Co., Ltd., Shenzhen, Guangdong Province (CN)

( * ) Notice: Subject to any disclaimer, the term of this patent is extended or adjusted under 35 U.S.C. 154(b) by 39 days.

(21) Appl. No.: 13/521,050

(22) PCT Filed: Jun. 5, 2012

(86) PCT No.: PCT/CN2012/076456
§ 371 (c)(1), (2), (4) Date: Jul. 7, 2012

(87) PCT Pub. No.: WO2013/177803
PCT Pub. Date: Dec. 5, 2013

(65) Prior Publication Data
US 2013/0323987 A1 Dec. 5, 2013

(51) Int. Cl.
*H01R 24/00* (2011.01)
*F21V 29/00* (2006.01)

(52) U.S. Cl.
USPC ..... 439/699.2; 362/267

(58) Field of Classification Search
USPC ..... 439/66, 67, 86, 699.2, 701; 362/267, 362/431, 645
See application file for complete search history.

(56) References Cited

U.S. PATENT DOCUMENTS

| | | | | |
|---|---|---|---|---|
| 4,023,079 | A * | 5/1977 | Selover, Jr. et al. | 361/502 |
| 5,482,473 | A * | 1/1996 | Lord et al. | 439/67 |
| 6,796,810 | B2 * | 9/2004 | DelPrete et al. | 439/86 |
| 7,061,169 | B1 * | 6/2006 | Fung | 313/318.01 |
| 7,705,618 | B2 * | 4/2010 | Kimura et al. | 324/755.08 |
| 8,419,448 | B2 * | 4/2013 | Konno | 439/86 |

FOREIGN PATENT DOCUMENTS

| | | | |
|---|---|---|---|
| CN | 1838379 | A | 9/2006 |
| CN | 101349836 | A | 1/2009 |

* cited by examiner

*Primary Examiner* — Chandrika Prasad
(74) *Attorney, Agent, or Firm* — Cheng-Ju Chiang

(57) ABSTRACT

The present invention provides a socket, which includes an insulation housing, conductive silicone rubber received in the insulation housing, and a conductive plate mounted to the insulation housing. The conductive plate has an end electrically connected to the conductive silicone rubber and an opposite end extending outside the insulation housing for external electrical connection. The present invention provides a socket that comprises an insulation housing in which a block of flexible conductive silicone rubber is received and retained to allow a lead pin of a light tube to be easily inserted into the conductive silicone rubber for realizing mounting the light tube to socket to be in electrical connection with the socket. Further, the conductive silicone rubber used in the present invention shows a cushioning capability that provides protection to the light tube.

8 Claims, 5 Drawing Sheets

SOCKET HAVING AN INSULATING HOUSING WITH A CONDUCTIVE SILICONE RUBBER INSERT FOR HOLDING AND ELECTRICALLY CONNECTING A LIGHT TUBE

BACKGROUND OF THE INVENTION

1. Field of the Invention

The present invention relates to a socket, and in particular to a socket for easy mounting of light tube.

2. The Related Arts

For a backlight module of liquid crystal display (LCD) that use uses a light tube as a light source, to mount the light tube, connection is often done with mechanical snap fitting. As shown in FIGS. 1-3, schematic views showing the conditions before and after a light tube of a backlight module of LCD is mounted to a socket are given. The socket 200 comprises a base 202 and two symmetrically-arranged resilient metal plates 204, 206 extending upward from the base 202. The two resilient metal plates 204, 206 each form, at a middle portion thereof, an outward projecting retention section 208, 210. The light tube 300 comprises a tubular body 302 and a lead pin 304 electrically connected to the tubular body 302. To mount, the lead pin 304 of the light tube 300 is pressed through an opening 212 formed at free ends of the two resilient metal plates 204, 206 of the socket 200 down to the retention sections 208, 210 so as to fix and electrically connect the light tube 300 to the socket 200.

However, to set the light tube in the socket, force is required for pressing down. This may easily cause deflection of the lead pin of the light tube, or even breaking the tuber body of the light tube. It also needs forcibly pulling out the lead pin of the light tube in dismounting the light tube and this may also cause deflection of the lead pin of the light tube or breaking the tubular body of the light tube. The mounting process is quite time-consuming and the operation is hard to handle.

Thus, it is desired to have a novel structure of socket to realize easy mounting and protection of light tube against damage, while ensuring electrical connection of the light tube.

SUMMARY OF THE INVENTION

An object of the present invention is to provide a socket, which has a simple structure, allows easy mounting and dismounting of the light tube, and is helpful in protecting the light tube.

To achieve the object, the present invention provides a socket, which comprises: an insulation housing, conductive silicone rubber received in the insulation housing, and a conductive plate mounted to the insulation housing. The conductive plate has an end electrically connected to the conductive silicone rubber and an opposite end extending outside the insulation housing for external electrical connection.

The insulation housing has an end forming an opening and the opening defines an inward recessed receiving space. The conductive silicone rubber is received in the receiving space.

The insulation housing has a sidewall for the receiving space, which defines a mounting surface mountable to a circuit board. The sidewall forms a mounting hole. The conductive plate is received in the mounting hole with an end electrically connected to the conductive silicone rubber and an opposite end extending outside the insulation housing for electrical connection with the circuit board.

The conductive silicone rubber forms an exposed outside surface that corresponds to the opening of the insulation housing to allow a lead pin of a light tube to insert through the outside surface into the conductive silicone rubber for mounting the light tube to the socket to be electrically connected to the socket.

The outside surface of the conductive silicone rubber forms a recess for receiving an end of the light tube.

The recess is located at a center of the outside surface of the conductive silicone rubber and the mounting surface is a planar surface.

The conductive silicone rubber forms an insertion bore extending inward from bottom of the recess for receiving insertion of the lead pin of the light tube therein.

The insulation housing is made of a plastic insulation material.

The conductive silicone rubber is flexible and the conductive plate is a metal plate.

The socket is applicable to a backlight module of liquid crystal display.

The efficacy of the present invention is that the present invention provides a socket that comprises an insulation housing in which a block of flexible conductive silicone rubber is received and retained to allow a lead pin of a light tube to be easily inserted into the conductive silicone rubber for realizing mounting the light tube to socket to be in electrical connection with the socket. The problem of the prior art that a great effort is taken to mount a light tube to a socket that might cause damage of the light tube is overcome. Further, the conductive silicone rubber used in the present invention shows a cushioning capability that provides protection to the light tube.

For better understanding of the features and technical contents of the present invention, reference will be made to the following detailed description of the present invention and the attached drawings. However, the drawings are provided for the purposes of reference and illustration and are not intended to impose undue limitations to the present invention.

BRIEF DESCRIPTION OF THE DRAWINGS

The technical solution, as well as beneficial advantages, will be apparent from the following detailed description of embodiments of the present invention, with reference to the attached drawings. In the drawings.

DETAILED DESCRIPTION OF THE PREFERRED EMBODIMENTS

To further expound the technical solution adopted in the present invention and the advantages thereof, a detailed description is given to a preferred embodiment of the present invention and the attached drawings.

Figure 1:
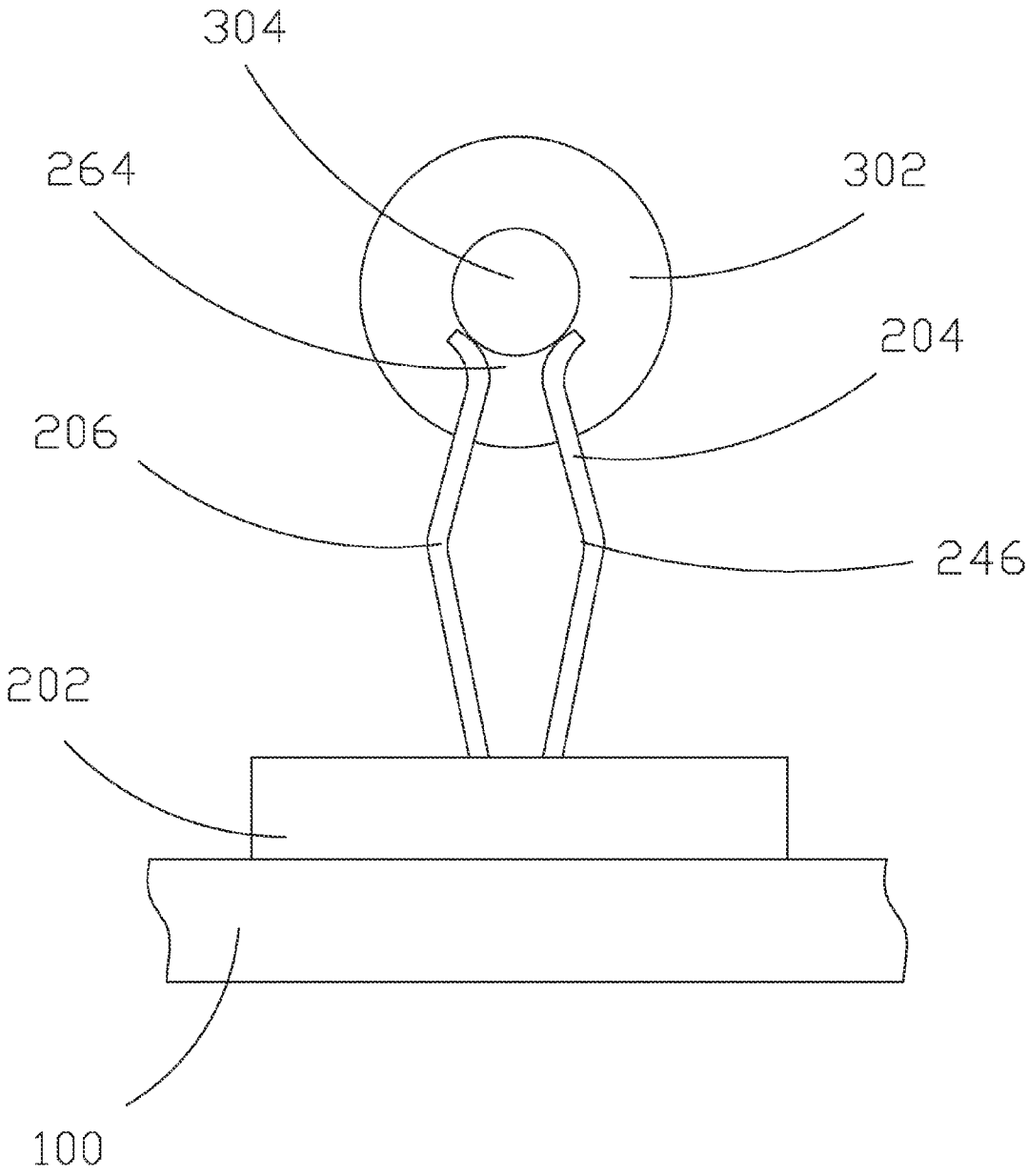
Fig. 1 (Prior Art)
FIG. 1 is a schematic view showing a condition before a light tube of a backlight module of a conventional liquid crystal display (LCD) is mounted to a socket.
Figure 2:
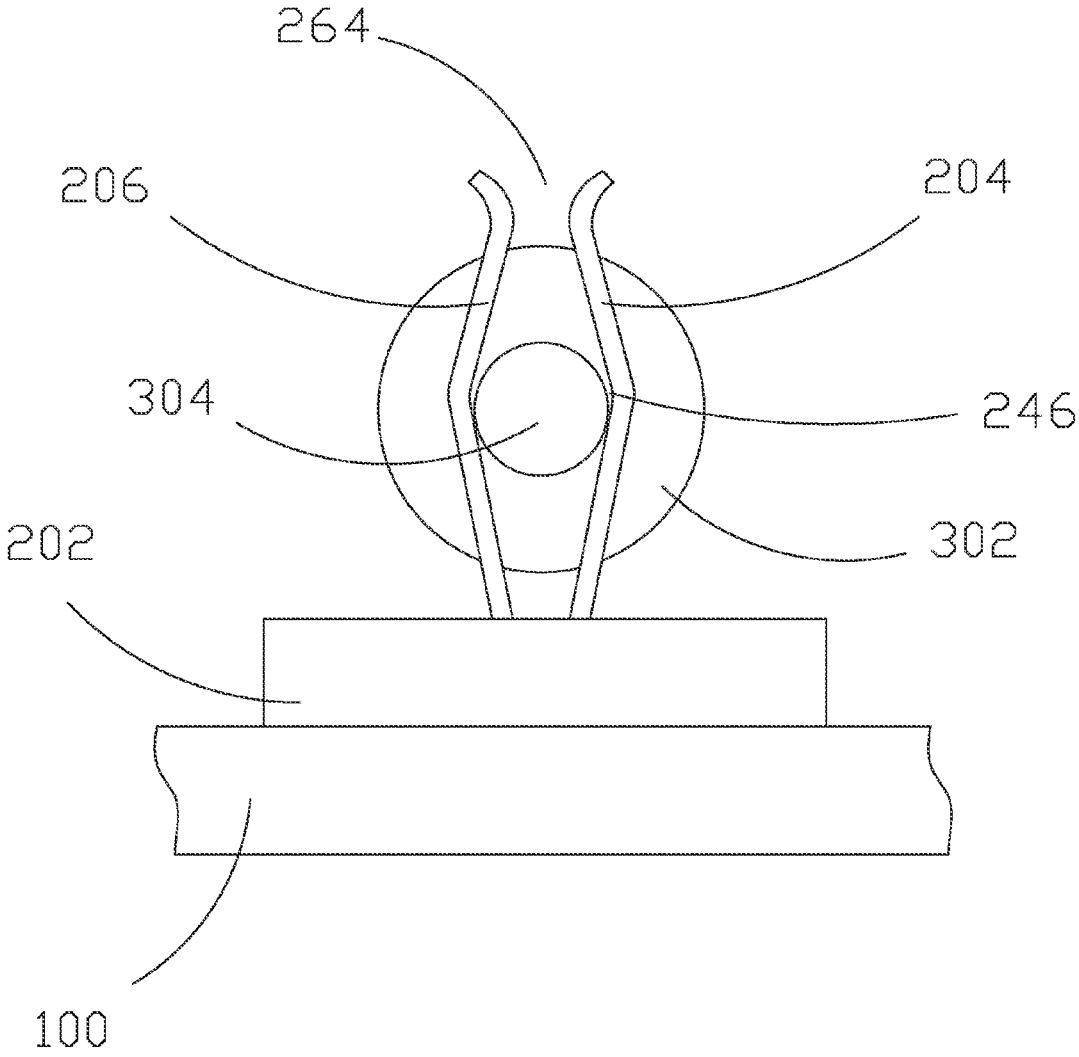
Fig.2 (Prior Art)
FIG. 2 is a schematic view showing a condition after the light tube of the backlight module of the conventional LCD is mounted to a socket.
Figure 3:
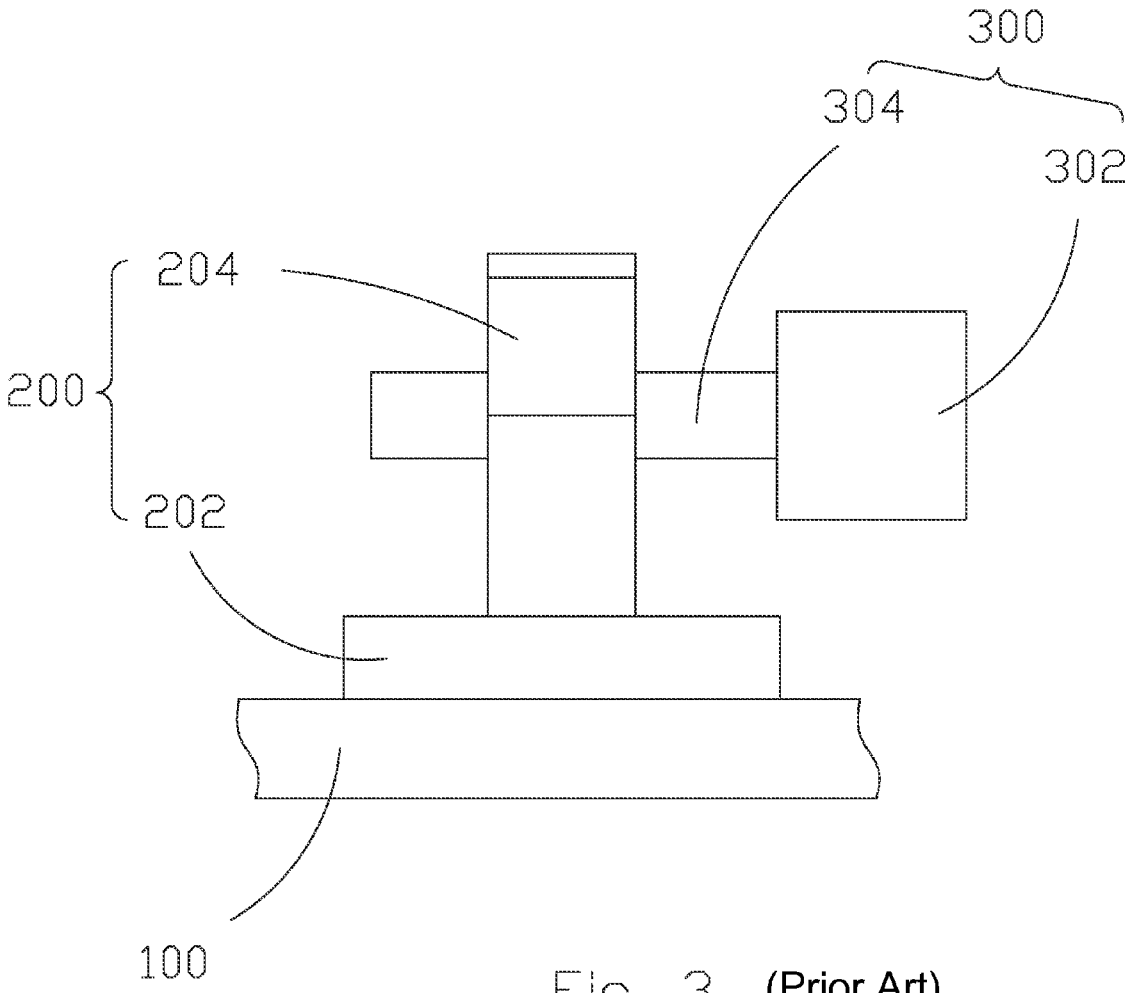
Fig. 3 (Prior Art)
FIG. 3 is a side elevational view of FIG. 2.
Figure 4:
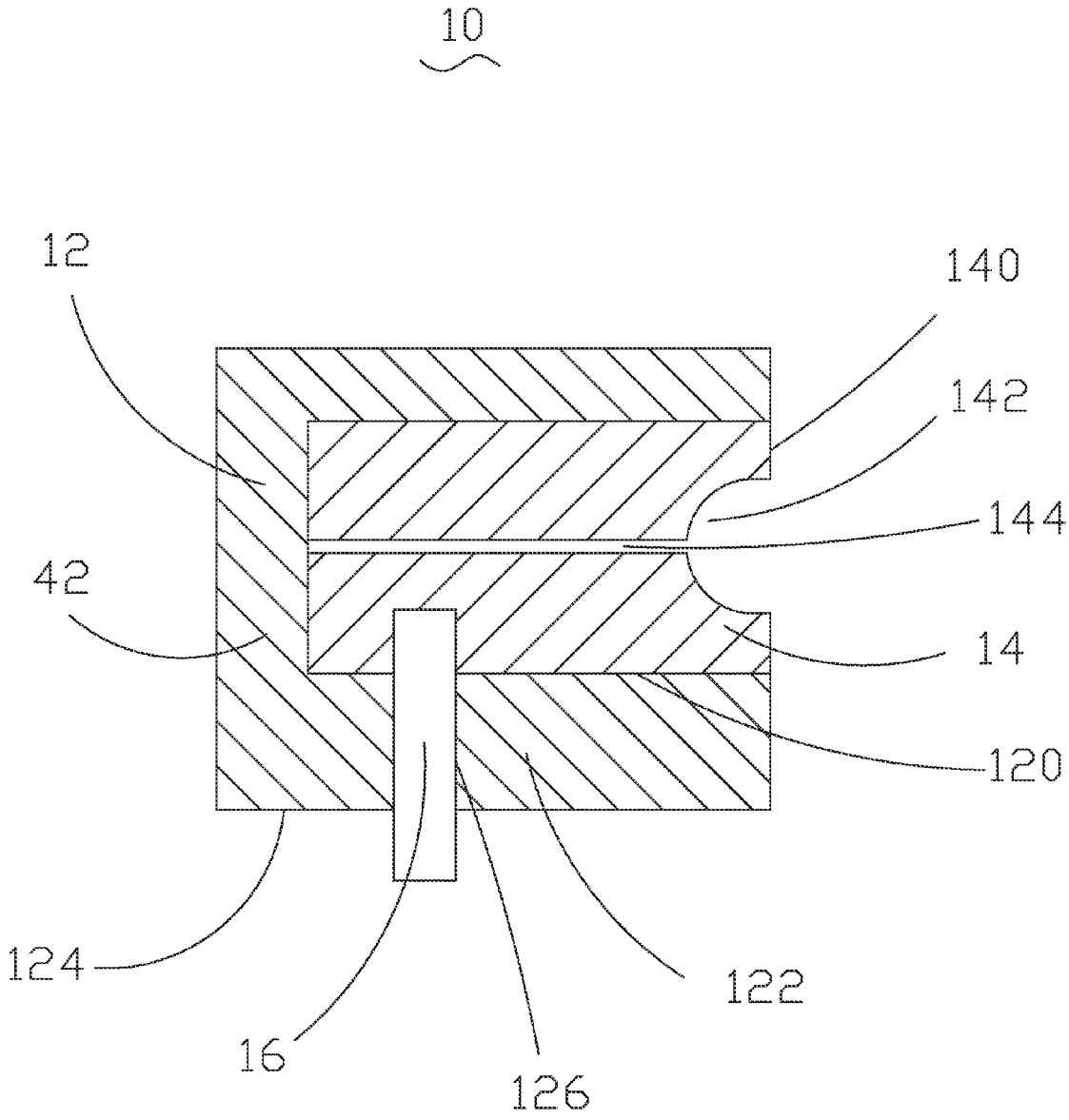
FIG. 4 is schematic view showing a socket according to the present invention.
Figure 5:
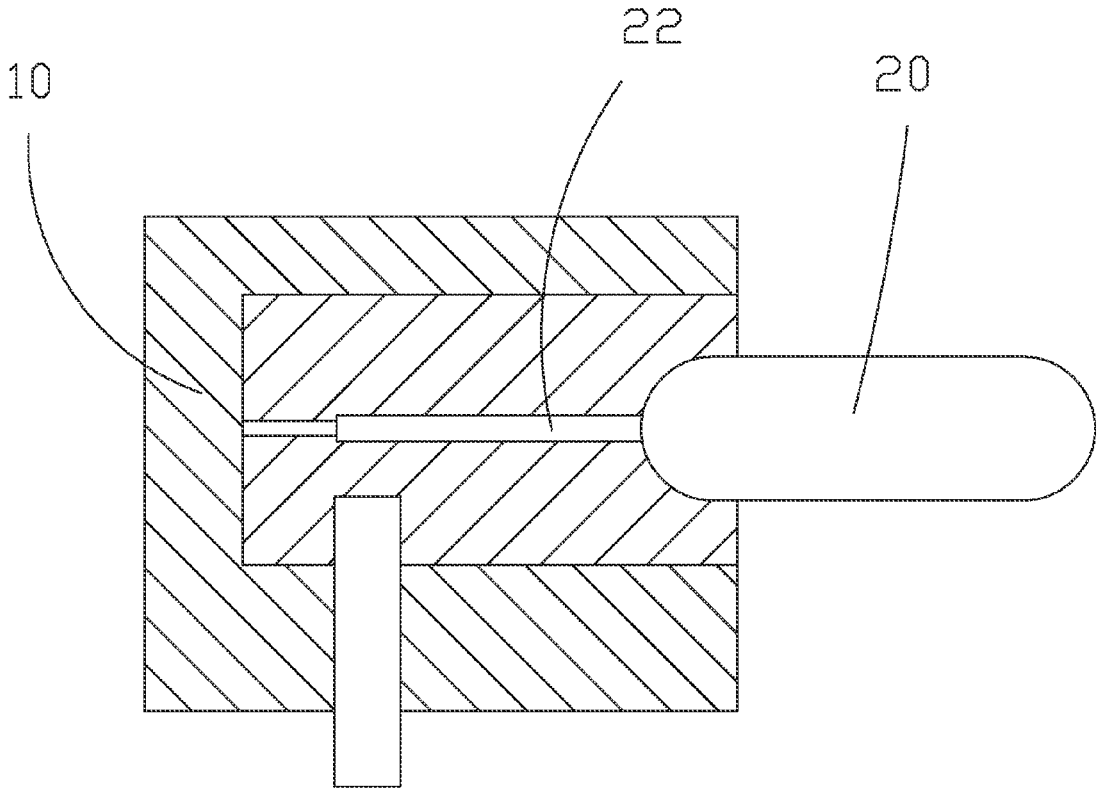
FIG. 5 is a schematic view showing a condition after a light tube is mounted to the socket according to the present invention.

Referring to FIGS. 4 and 5, the present invention provides a socket 10, which comprises: an insulation housing 12, conductive silicone rubber 14 received in the insulation housing 12, and a conductive plate 16 mounted to the insulation housing 12. The conductive plate 16 has an end that is in electrical connection with the conductive silicone rubber 14 and an opposite end extending outside the insulation housing 12 for external electrical connection. The opposite end of the conductive plate 16 can be in the form of a pad for surface-mounting soldering or a pin-like terminal for through-hole soldering.

The insulation housing 12 is made of an insulation material, such as plastic, and has an end forming an opening 120. The opening 120 defines an inward recessed receiving space (not labeled) and the conductive silicone rubber 14 is received in the receiving space.

The insulation housing 12 has a sidewall 122 for the receiving space, which defines a mounting surface 124 mountable to a circuit board (not shown). The mounting surface 124 is a planar surface. The sidewall 122 forms a mounting hole 126. The conductive plate 16 is a metal plate that is received in the mounting hole 126 with an end electrically connected to the conductive silicone rubber 14 and an opposite end extending outside the insulation housing 12 for electrical connection with the circuit board.

The conductive silicone rubber 14 is flexible and forms an exposed outside surface 140 that corresponds to the opening 120 of the insulation housing 12 to allow a lead pin 22 of a light tube 20 to insert through the outside surface 140 into the conductive silicone rubber 14 for mounting the light tube 20 to the socket 10 to be electrically connected to the socket 10.

Preferably, the outside surface 140 of the conductive silicone rubber 14 forms a recess 142 for receiving an end of the light tube 20. The recess 142 is located at a center of the outside surface 140 of the conductive silicone rubber 14. Since the conductive silicone rubber 14 is flexible, cushioning and protection can be realized on the light tube 20.

The conductive silicone rubber 14 also forms an insertion bore 144 extending inward from bottom of the recess 142 for receiving insertion of the lead pin 22 of the light tube 20 therein. The insertion bore 144 has a diameter that is smaller than the diameter of the lead pin 22 of the light tube 20 in order to ensure tight engagement between the lead pin 22 and the conductive silicone rubber 14 and thus ensuring stable electrical connection.

Preferably, the socket 10 is applicable to a backlight module of LCD.

The present invention provides a socket that comprises an insulation housing in which a block of flexible conductive silicone rubber is received and retained to allow a lead pin of a light tube to be easily inserted into the conductive silicone rubber for realizing mounting the light tube to socket to be in electrical connection with the socket. The problem of the prior art that a great effort is taken to mount a light tube to a socket that might cause damage of the light tube is overcome. Further, the conductive silicone rubber used in the present invention shows a cushioning capability that provides protection to the light tube.

Based on the description given above, those having ordinary skills of the art may easily contemplate various changes and modifications of the technical solution and technical ideas of the present invention and all these changes and modifications are considered within the protection scope of right for the present invention.

What is claimed is:

1. A socket, comprising: an insulation housing, a conductive silicone rubber received in the insulation housing, and a conductive plate mounted to the insulation housing, the conductive plate having an end electrically connected to the conductive silicone rubber and an opposite end extending outside the insulation housing for external electrical connection, wherein the conductive silicone rubber has an exposed outside surface forming a recess for receiving and directly engaging an end of a tuber body of a light tube to resiliently support the light tube and the conductive silicone rubber forms an insertion bore extending inward from a bottom of the recess for receiving insertion of a lead pin extending from the tube body of the light tube to electrically engage the lead pin, whereby the conductive silicone rubber simultaneously electrically engage the light tube and resiliently support the light tube.

2. The socket as claimed in claim 1, wherein the insulation housing has an end forming an opening and the opening defines an inward recessed receiving space, the conductive silicone rubber being received in the receiving space in such a way that the exposed outside surface of the conductive silicone rubber is substantially flush with the end of the insulation housing.

3. The socket as claimed in claim 2, wherein the insulation housing has a sidewall for the receiving space, which defines a mounting surface mountable to a circuit board, the sidewall forming a mounting hole, the conductive plate being received in the mounting hole with an end electrically connected to the conductive silicone rubber and an opposite end extending outside the insulation housing for electrical connection with the circuit board.

4. The socket as claimed in claim 3, wherein the recess is located at a center of the outside surface of the conductive silicone rubber and the mounting surface is a planar surface.

5. The socket as claimed in claim 1, wherein the insulation housing is made of a plastic insulation material.

6. The socket as claimed in claim 1, wherein the conductive silicone rubber is flexible and the conductive plate is a metal plate.

7. The socket as claimed in claim 1, wherein the socket is used with a backlight module of a liquid crystal display.

8. A socket, comprising: an insulation housing, a conductive silicone rubber received in the insulation housing, and a conductive plate mounted to the insulation housing, the conductive plate having an end electrically connected to the conductive silicone rubber and an opposite end extending outside the insulation housing for external electrical connection;

wherein the insulation housing has an end forming an opening and the opening defines an inward recessed receiving space, the conductive silicone rubber being received in the receiving space;

wherein the insulation housing has a sidewall for the receiving space, which defines a mounting surface mountable to a circuit board, the sidewall forming a mounting hole, the conductive plate being received in the mounting hole with an end electrically connected to the conductive silicone rubber and an opposite end extending outside the insulation housing for electrical connection with the circuit board;

wherein the conductive silicone rubber has an exposed outside surface forming a recess for receiving and directly engaging an end of a tuber body of a light tube to resiliently support the light tube and the conductive silicone rubber forms an insertion bore extending inward from a bottom of the recess for receiving insertion of a lead pin extending from the tube body of the light tube to electrically engage the lead pin, whereby the conductive silicone rubber simultaneously electrically engage the light tube and resiliently support the light tube;

wherein the recess is located at a center of the outside surface of the conductive silicone rubber and the mounting surface is a planar surface;

wherein the insulation housing is made of a plastic insulation material;

wherein the conductive silicone rubber is flexible and the conductive plate is a metal plate; and wherein the socket is used with a backlight module of a liquid crystal display.

* * * * *